United States Patent [19]

Sheng et al.

[11] 4,263,465

[45] Apr. 21, 1981

[54] SYNTHETIC LUBRICANT

[75] Inventors: Ming N. Sheng, Cherry Hill, N.J.; Mary T. Arnold, Upland, Pa.

[73] Assignee: Atlantic Richfield Company, Los Angeles, Calif.

[21] Appl. No.: 74,190

[22] Filed: Sep. 10, 1979

[51] Int. Cl.[3] ..... C07C 9/00; C07C 2/74

[52] U.S. Cl. ..... 585/18; 585/12; 585/255; 585/312; 585/329; 585/510; 585/517

[58] Field of Search ..... 585/18, 255, 312, 329, 585/510, 517, 12

[56] References Cited

U.S. PATENT DOCUMENTS 4,172,855 10/1979 Shubkin et al. ..... 585/18

*Primary Examiner*—Curtis R. Davis

*Attorney, Agent, or Firm*—Coleman R. Reap

[57] ABSTRACT

A low viscosity synthetic lubricant is prepared by polymerizing 1-butene to an oligomer containing a number average of about 8 to 18 carbon atoms and copolymerizing the oligomer with an alpha-monoolefin having 8 to 18 carbon atoms to produce a copolymer having an average of about 20 to 40 carbon atoms. Both polymerization reactions are catalyzed by a combination of boron trifluoride and a proton donor promoter. The synthetic lubricant is preferably stripped to remove lower boiling components, such as oligomers having 20 carbon atoms or less, and optionally hydrogenated for improved stability.

21 Claims, No Drawings

SYNTHETIC LUBRICANT

BACKGROUND OF THE INVENTION

This invention relates to synthetic lubricants and more particularly to synthetic lubricants prepared from alpha-monoolefins.

It has long been know that synthetic lubricants having superior viscosity and stability properties can be prepared by the controlled polymerization of alpha-monoolefins. For example, U.S. Pat. Nos. 2,500,163, 2,937,129, 3,382,291 and 3,769,363 disclose the preparation of synthetic lubricants by the polymerization of alpha-monoolefins containing about 5 to 18 carbon atoms. Even though such synthetic lubricants have good viscosity and oxidation stability properties they have not been commercially available until recently because they are considerably more expensive to manufacture than conventional lubricants. Increasing demand for high quality lubricants for fuel efficient engines over the last few years has led to the commercialization of such synthetic lubricants. The most commercially successful synthetic lubricants are those prepared from higher alpha-olefins, particularly those having having about 8 to 12 carbon atoms. These olefins are polymerized under conditions such that the resulting polymer is comprised substantially of trimers and tetramers of the alpha-monoolefin. These polymers have good viscosity characteristics, however, the monomers from which they are produced are in relatively short supply and hence they are costly. Attempts have been made to prepare olefin-based synthetic lubricants from the more widely available and less expensive lower alpha-olefins. For example, the preparation of synthetic lubricants from lower alpha-monoolefins, including butene-1, has been reported in U.S. Pat. Nos. 2,357,926 and 2,631,176. Synthetic lubricants made from these materials are less desirable than synthetic lubricants prepared from the higher alpha-olefins since they generally have a wide molecular weight distribution and thus a smaller percentage of product is in the stable, low viscosity lubricating oil range.

The preparation of synthetic lubricants by the copolymerization of mixtures of lower and higher alpha-olefins has been disclosed in U.S. Pat. No. 2,500,162 but these polymers are generally obtained in low yield and are less desirable as synthetic lubricants because they, too, have a wide molecular weight range due to the different polymerization rates of the lower and higher alpha-olefins.

A process has now been developed for the preparation of high quality, less expensive synthetic lubricants which avoids the above-mentioned drawbacks.

Accordingly, it is an object of the invention to present a new process for the preparation of synthetic lubricants. It is another object of the invention to present new synthetic lubricants which have superior viscosity and oxidation stability properties. It is another object of the invention to present superior synthetic lubricants derived from butene-1. It is another object of the invention to present a process for preparing synthetic lubricants from butene-1. It is another object of the invention to present a process for producing copolymers of butene-1 and higher alpha-monoolefin in high yields and having good lubricating oil properties. These and other objects of the invention will become more apparent from the following description of the invention.

SUMMARY OF THE INVENTION

The above objects are accomplished by the interpolymerization of butene-1 oligomer and a higher alpha-monoolefin. The butene-1 oligomer is prepared in a first step comprising polymerizing butene-1 to an oligomer having a number average of about 8 to about 18 atoms per molecule in the presence of free boron trifluoride and a boron trifluoride-promoter complex catalyst at a temperature of about −30° to 50° C. and a pressure sufficiently high to keep the butene-1 in the liquid state. The butene-1 oligomer-higher alpha-monoolefin copolymer is prepared in a second step comprising interpolymerizing the butene-1 oligomer product and an alpha-monoolefin component having 8 to 18 carbon atoms per molecule to a copolymer product having an average of about 20 to 40 carbon atoms per molecule using a free boron trifluoride and a boron trifluoride-promoter catalyst complex which is the same as or similar to the catalyst complex used in the first step. The second step reaction is conducted at a temperature of about −30° to 60° C. and a pressure of about 0 to 200 psig. The copolymer product may be stripped to remove product having about 20 or fewer carbon atoms. The product is desirably hydrogenated to improve its stability.

DETAILED DESCRIPTION OF THE INVENTION

According to a preferred embodiment of the invention, the first step of the process, the butene oligomerization, is carried out by reacting the butene-1, in a suitable reaction vessel, preferably a pressure reaction vessel, by means of a catalyst system comprised of free boron trifluoride and a boron trifluoride-promoter complex. The order of addition of reactant and catalyst-promoter complex to the reactor is not critical, however, since the catalyst-promoter complex is a liquid at atmospheric temperature and pressure, whereas the butene-1 is normally a gas it is convenient to add the catalyst complex to the reactor, seal the reactor, and then charge the butene-1. The reactor is then pressurized to the desired pressure, preferably with pure boron trifluoride, and the oligomerization reaction is ready to proceed.

The promoter used with the boron trifluoride is desirably a proton donor compound. Suitable proton donors include water and organic oxygen-containing compounds, such as acids, alcohols, esters, aldehydes, ketones, etc. Such catalyst systems are well described in the literature. For example, the polymerization of alpha-monoolefins using proton donor-promoted boron trifluoride catalyst systems is described in U.S. Pat. Nos. 2,182,617, 2,379,656, 2,631,176, 2,801,273, 3,382,291 and 3,769,363 and French patent disclosure 793,226. The preferred proton donor promoters for use in the present invention are the organic acids, particularly the lower saturated aliphatic acids, such as acetic acid, the butyric acids and the valeric acids.

If desired, the catalyst promoter and the boron trifluoride can be charged to the reactor separately without first forming a complex. However, when this procedure is followed the reaction undergoes an induction period while the boron trifluoride and promoter form a complex. To avoid this, the boron trifluoride-promoter complex is desirably prepared prior to the oligomerization reaction.

The boron trifluoride-promoter complex is prepared by contacting the promoter, i.e., the proton donor, with boron trifluoride. This can be conveniently accomplished by bubbling boron trifluoride gas through the promoter until the promoter is saturated with the boron trifluoride.

The amount of catalyst-promoter complex used in the butene-1 oligomerization reaction is not critical and may vary from the minimum amount which is effective to catalyze the polymerization reaction up to about 10 mole % or more, based on the total number of moles of butene-1 present in the reaction zone. Greater amounts than 10 mole % can be used but such large amounts are not economical or necessary. In general, it is usual to use about to 0.1 to 10% and preferably about 0.5 to 5 mole % or boron trifluoride-saturated promoter based on the total number of moles of butene-1 in the reaction zone. The above percentages are based on the moles of boron trifluoride-free promoter in the reaction zone. The amount of boron trifluoride present in the catalyst complex will depend upon the solubility characteristics of the boron trifuloride in the promoter at the existing conditions. Since the reactor is usually pressurized with free boron trifluoride gas the amount of boron trifluoride present in the reaction zone is generally somewhat in excess of the minimum amount required for polymerization, which is desirable.

The butene-1 oligomerization is preferably conducted under reaction conditions that will result in the oligomer product having substantially all of its carbon chain lengths in the range of about 8 to 32 atoms per molecule and having a number average of about 8 to 18 and preferably 10 to 16 carbon atoms per molecule. It has been determined that the oligomer interpolymerizes more uniformly with the alpha-monoolefin when most of the oligomer has a carbon atom range near that of the alpha-monoolefin. Small amounts of higher molecular weight oligomer, such as oligomer containing an average of about 20 to 32 carbon atoms, will not adversely affect the sound step polymerization or product since this material is less reactive than the lower molecular weight oligomer and generally does not undergo further polymerization or copolymerization. One factor that influences the degree of polymerization of the butene-1 is the temperature at which the oligomerization takes place. It has been observed that conducting the butene-1 oligomerization at a temperature of less than about −20° C. results in a product having an undesirably high molecular weight and, conversely, conducting the oligomerization at a temperature greater than about 50° C. results in an oligomer having a molecular weight which is too low for efficient copolymerization in the second stage. Accordingly, it is preferred to conduct the butene-1 oligomerization at a temperature of about −20° to 50° C. and most preferably at a temperature of about −10° to 20° C.

The oligomerization of the butene-1 is preferably carried out at a pressure sufficiently high to maintain the butene-1 in the liquid phase. Since the reaction temperature is about −20° to 50° C. it is desirable to conduct the butene-1 oligomerization reaction under a pressure of about 20 to 200 psig. As noted above the reaction vessel is conveniently pressurized by the catalyst, boron trifluoride.

It has also been determined that the reaction time of the butene-1 oligomerization influences the degree of polymerization of the reaction product. Increasing the length of the reaction period results in an increase in the molecular weight of the oligomer. Accordingly, it is preferred to conduct the butene-1 oligomerization only for a sufficient period of time to produce the desired product. This is usually accomplished in about 60 minutes or less. It is preferred to carry out the butene-1 oligomerization reaction for about 10 to 30 minutes. The optimum reaction time will, of course, depend upon other factors, such as the reaction temperature, the amount of catalyst used, etc.

When the butene-1 oligomer reaches the desired degree of polymerization the reaction is terminated. This can be accomplished by venting off the boron trifluoride and the unreacted butene-1 and quenching the reaction with water. If the butene-1 oligomer obtained in the first step of the invention is to be directly used as a reactant for the second step there is no need for quenching or removal of catalyst residue since the catalyst system used in the second step is identical to or similar to the catalyst system used in the first step. However, if it is desirable to quench the first step reaction this can be accomplished by adding water to the reaction mixture. If this alternative is followed the water and the acids formed by the quenching should be removed from the butene-1 oligomer and the oligomer should be dried prior to its use in the second stage polymerization reaction. Also, if it is desired, butene-1 monomer and dimer may be removed, as by distillation, from the first step oligomer product.

In carrying out the second step of the invention, the butene-1 oligomer is combined with the higher alpha-monoolefin in a suitable reaction vessel. Fresh catalyst-promoter complex can, if needed, be charged into the reactor. As was the case in the first step the order of addition of reactants and catalyst is not critical. Since the second step reactants have boiling points higher than butene-1 it is not absolutely essential that the reaction vessel be pressurized. The reaction can be carried out at atmospheric pressure by bubbling free boron trifluoride catalyst through the reaction mixture, preferably in a closed vessel. However, it is usually more efficient to carry out the reaction in a reactor pressurized with boron trifluoride. In any event, the pressure in the reaction vessel during the second step reaction may be varied from atmospheric pressure to about 200 psig atmospheres. Upon introduction of the reactants and catalyst to the reactor the second step of the invention is ready to proceed.

The higher alpha-monoolefin component of the cooligomerization reaction mixture may be a single alpha-monoolefin or a mixture of two or more alpha-monoolefins. When the alpha-monoolefin is a single alpha-olefin it generally has about 8 to 18 and preferably about 10 to 16 carbon atoms. Preferred alpha monoolefins include decene-1, dodecene-1, tetradecene-1 and hexadecene-1. When the monoolefin is a mixture of two or more alpha-monoolefins it generally has substantially all of its olefin components in the 10 to 16 carbon atom range. When alpha-olefins are obtained by cracking processes thay may contain small amounts of olefinic materials outside of the 8 to 18 carbon atom alpha-monoolefin range including such materials as monoolefins having unsaturation in positions other than the alpha-position or monoolefins having fewer than 8 or more than 18 carbon atoms in their molecules or polyunsaturated olefins such as diolefins. These materials, when present in small amounts, will not interfere with the desired cooligomerization reaction or adversely affect the product.

The ratio of butene-1 oligomer to higher alpha-olefin in the product may be varied over a wide range. It is usually desirable to incorporate high percentages of the butene-1 into the product since the butene-1 is much less expensive than the higher alpha-monoolefin reactants. In general, the percentage of butene-1 units in the second step polymerization product may vary from about 10 to 80 and preferably about 30 to 70 weight percent, based on the total weight of polymeric product.

The temperature of the butene oligomer-higher alpha-monoolefin interpolymerization may be varied from about −30° to 60° C. As was the case in the butene-1 oligomerization, low reaction temperatures result in the production of higher molecular weight product and high reaction temperatures result in the formation of product having a low molecular weight. The preferred reaction temperature for the second step reaction is about −10° to 30° C.

The concentration of boron trifluoride-promoter complex used in the butene oligomer-alpha-monoolefin oligomerization is generally the same as the concentration used in the butene-1 oligomerization reaction. Thus, the concentration of boron trifluoride-promoter complex used in the second step usually varies from about 0.1 to 10 mole percent and preferably varies from about 0.5 to 5 mole percent based on the combined total moles of butene oligomer and alpha-monoolefin present in the reaction zone. These percentages are based on the moles of boron trifluoride-free promoter in the reaction zone.

Any of the promoters which were used in the butene-1 oligomerization can be used in the butene-1 oligomer-higher alpha-monoolefin cooligomerization reaction. As in the first step the preferred promoters are the lower saturated aliphatic acids, such as acetic acid, the butyric acids and the valeric acids.

The second step reaction is desirably carried out for a sufficient length of time to obtain a high conversion of the reactants. The optimum duration of the reaction will be determined by such factors as the reaction temperature, the catalyst concentration, the desired molecular weight of the product, and the degree of conversion sought. In general, the second step reaction period usually does not exceed about 2 hours and is preferably in the range of about 30 to 90 minutes.

After the second step copolymerization has proceeded for the desired length of time the reaction is terminated such as by quenching with water. The product mixture can be neutralized by contact with a base such as ammonium hydroxide solution. The polymerization product is immiscible with water and can therefore be easily recovered from the quench water by gravitational separation techniques.

In order to obtain a more stable product it is often desirable to strip the second step product to remove the more volatile components, such as polymeric product having about 20 or fewer carbon atoms. This can be accomplished by any of the usual techniques, such as by vacuum distillation. The polymeric product can also be stabilized by hydrogenating the second step product. This, too, can be accomplished by well known means, such as by contacting the product with hydrogen in the presence of alumina-supported or kieselghur-supported nickel catalyst at a pressure of about 1000 to 3000 psig and a temperature of about 100° to 250° C.

Products obtained by the present process have excellent oxidative and thermal stability and automotive lubricating oil range properties such as a kinematic viscosity at 210° F. in the range of 3.5 to 4.5 centistokes, a viscosity index greater than 100 and a flash point of at least 375° F.

The following examples illustrate specific embodiments of the invention. Parts and percentages are on a weight basis unless otherwise indicated. The kinematic viscosity was determined in accordance with ASTM D445-74 the viscosity index was determined in accordance with ASTM D2270-75 and the flash point was determined in accordance with ASTM D92-66.

EXAMPLE I

Part A

A boron trifluoride-promoter complex is prepared by bubbling boron trifluoride gas through n-valeric acid in a glass reaction vessel until the n-valeric acid is saturated with boron trifluoride. During the reaction the reactor contents are continuously agitated and cooled to keep the temperature of the reactor contents below about 50° C. Next 2.3 g of the promoter complex is added to a 250 ml Fisher Porter glass pressure bottle equipped with an agitator and then 50.3 g of liquified butene-1 is charged to the reaction bottle. The reaction bottle is then submerged in an ice bath maintained at 0° C. and the reaction bottle is pressured to 65 psig with boron trifluoride gas. The vessel is maintained in the ice bath with continuous agitation for a period of ten minutes, after which unreacted butene-1 and boron trifluoride are vented off and the reaction is quenched with distilled water. The butene-1 oligomer product is separated from the water by gravitational separation separation in a separatory funnel. The resulting product is then dried with calcium hydride. A product yield of 97.0%, based on the weight of butene-1 charged to the reactor, is realized. The oligomer product has the following weight distribution: 13.2% $C_8$, 55.5% $C_{12}$, 17.5% $C_{16}$ 6.5% $C_{20}$ 1.9% $C_{24}$ 0.7% $C_{28}$ and 0.5% $C_{32}$.

Part B

In this example butene oligomer which is prepared in the manner described in Part A but having the following product weight distribution is used: 5.1% $C_8$, 48.1% $C_{12}$, 26.3% $C_{16}$, 3.5% $C_{20}$, 4.8% $C_{24}$. Into a glass round bottom reaction flask are charged 8.6 g of n-valeric acid-boron trifluoride complex, 214.1 g of dodecene-1 and 259.8 g of butene-1 oligomer having the above product distribution. The reactor is then sealed and pressurized with boron trifluoride to a pressure of 2 psig. The reaction is then permitted to proceed for 90 minutes with continuous agitation, during which time the temperature is maintained at 10° C. with cooling and the pressure is maintained at about 2 psig with boron trifluoride gas. The reaction is then terminated by quenching the reactor contents with distilled water. The product is washed first with 10 weight % ammonium hydroxide solution to neutralize the product and then with distilled water until the product mixture reaches neutral pH. The product, obtained in a yield of 77.4 weight %, based on the total weight of reactants, is stripped to remove lower molecular weight polymeric product and hydrogenated by contact with hydrogen in the presence of an alumina-supported nickel catalyst at a temperature of 200° C. and a pressure of 2200 psig. The product has a kinematic viscosity at 210° F. of 3.6 centistokes, a viscosity index of 114 and a flash point of 405° F.

EXAMPLE II

The procedure of EXAMPLE I, Part B is repeated except that 243.7 g of tetradecene-1 is substituted for the dodecene-1, 8.2 g of boron trifluoride-n-valeric acid complex is used and 245.7 g of butene-1 oligomer having the following product weight distribution is used: 4.8% $C_8$, 45.4% $C_{12}$, 27.3% $C_{16}$, 12.8% $C_{20}$, 5.6% $C_{24}$, 1.5% $C_{28}$, and 0.2% $C_{32}$. The reaction is carried out at 10° C. for 90 minutes. The product, obtained in a yield of 77.3% based on the weight of the reactants, is stripped to remove low molecular weight polymer and the stripped product is hydrogenated as in EXAMPLE I. The product has a kinematic viscosity at 210° F. of 3.9 centistokes, a viscosity index of 116 and a flash point of 415° F.

The preceding examples illustrate that the process of the invention is useful for obtaining synthetic lubricants in good yields and having excellent lubricating oil properties. Thus, butene-1, which was formerly used chiefly as a fuel and for the production of specialty chemicals, can now be used in the manufacture of high quality synthetic lubricants.

Although the preceding examples illustrate specific embodiments of the invention, it is understood that the breadth of the invention is not limited thereto but is defined by the scope of the appended claims.

What is claimed is:

1. A process for preparing a low viscosity synthetic lubricant comprising:

(a) as a first step polymerizing butene-1 to an oligomeric product having a number average carbon content of about 8 to 18 carbon atoms per molecule, and (b) as a second step copolymerizing the oligomer obtained in step 1 with at least one alpha-monoolefin having 8 to 18 carbon atoms to a polymeric product having an average of about 20 to 40 carbon atoms per molecule, said first and second polymerization steps being catalyzed by a boron trifluoride-promoter complex-free boron trifluoride catalyst system and the ratio of said oligomer and said alpha-monoolefin in the second step reaction zone being such that the resulting copolymer contains about 10 to 80% polybutene units based on the total weight of polymeric material in the product.

2. The process of claim 1 wherein the first step polymerization is carried out at a temperature of about −20° to 50° C. and said second step copolymerization is carried out at a temperature of about −30° to 60° C.

3. The process of claim 2 wherein the first step is carried for a period of about 10 to 30 minutes.

4. The process of claim 3 wherein the second step is carried out for a period of about 30 to 90 minutes.

5. The process of claim 1 wherein said promoter is a proton donor selected from the group consisting of water, organic acids, alcohols, esters, aldehydes, ketones and ethers and it is present in the first and second step reaction zones at a concentration of about 0.001 to 0.10 moles per mole of reactant.

6. The process of claim 5 wherein said first step polymerization is carried out at a temperature of about −10° to +20° C. and a pressure of about 20 to 200 psig, said second step copolymerization is carried out at a temperature of about −10° C. to 30° C. and a pressure of about 0 to 200 psig and said first and second steps are carried out in an atmosphere of predominantly boron trifluoride.

7. The process of claim 6 wherein the proton donor is a saturated aliphatic acid having up to 5 carbon atoms and it is present in the first and second step reaction zones at a concentration of about 0.005 to 0.05 moles per mole of reactant.

8. The process of claim 6 wherein said butene-1 oligomer has a number average of about 10 to 16 carbon atoms per molecule and said alpha-monoolefin has 10 to 16 carbon atoms.

9. The process of claim 8 wherein said alpha-monoolefin is selected from the group consisting of decene-1, dodecene-1, tetradecene-1, hexadecene-1, and mixtures of these.

10. The process of claim 7 wherein said alpha-monoolefin is selected from the group consisting of dodecene-1, tetradecene-1, and mixtures of these.

11. The process of claim 1 wherein the ratio of oligomer to alpha-monoolefin in the second step reaction mixture is such that the polymeric product obtained contains about 30 to 70% butene units based on the total weight of polymeric material in the product.

12. The process of claim 1 wherein the copolymer product is stripped to remove polymer product having fewer than about 20 carbon atoms per molecule.

13. The process of claim 12 wherein the stripped copolymer product is hydrogenated.

14. A process for preparing a low viscosity synthetic lubricant comprising (a) polymerizing butene-1 to an oligomer having a number average of about 10 to 16 carbon atoms per molecule at a temperature of about −10° to 20° C., and (b) copolymerizing the oligomer obtained in (a) with at least one alpha-monoolefin having 10 to 16 carbon atoms per molecule to a polymeric product having an average of about 20 to 40 carbon atoms per molecule at a temperature of about −10° to 30° C., steps (a) and (b) being catalyzed by a catalyst system comprised of free boron trifluoride and a boron trifluoride-promoter complex wherein said promoter is an aliphatic acid having up to five carbon atoms, the molar ratio of promoter to total reactive components in steps (a) and (b) being about 0.005 to 0.05, and the ratio of oligomer to alpha-monoolefin in the step (b) reaction zone being such that the polymeric product obtained from step (b) contains about 30 to 70% butane units based on the total weight of step (b) polymeric product.

15. The process of claim 14 wherein said alpha-monoolefin is selected from the group consisting of decene-1, dodecene-1, tetradecene-1, hexadecene-1 and mixtures of these.

16. The process of claim 14 wherein said alpha-monoolefin is selected from the group consisting of dodecene-1, tetradecene-1 and mixtures of these.

17. A synthetic lubricant comprised of a copolymer of a butene oligomer having a number average of 8 to 18 carbon atoms and at least one alpha-monoolefin having 8 to 18 carbon atoms, said copolymer having an average of about 20 to 40 carbon atoms per molecule.

18. The product of claim 17 wherein said alpha-monoolefin has 10 to 16 carbon atoms.

19. The product of claim 18 wherein said alpha-monoolefin is selected from the group consisting of decene-1, dodecene-1, tetradecene-1, hexadecene-1 and mixtures of these.

20. The product of claim 18 wherein said alpha-monoolefin is selected from the group consisting of dodecene-1, tetradecene-1 and mixtures of these.

21. The synthetic lubricant of claim 17 wherein said copolymer is stripped to remove polymeric product having fewer than about 20 carbon atoms and the resulting stripped polymeric product is hydrogenated.

* * * * *